US008594528B2

(12) United States Patent
Ferrar et al.

(10) Patent No.: US 8,594,528 B2
(45) Date of Patent: Nov. 26, 2013

(54) ELECTROSTATOGRAPHIC CLEANING BLADE MEMBER AND APPARATUS

(75) Inventors: Wayne T. Ferrar, Fairport, NY (US); Francisco L. Ziegelmuller, Penfield, NY (US); James D. Shifley, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 349 days.

(21) Appl. No.: 13/117,187

(22) Filed: May 27, 2011

(65) Prior Publication Data

US 2012/0301176 A1 Nov. 29, 2012

(51) Int. Cl.
*G03G 15/16* (2006.01)

(52) U.S. Cl.
USPC ..... 399/101

(58) Field of Classification Search
USPC ..... 399/350, 101
See application file for complete search history.

(56) References Cited

U.S. PATENT DOCUMENTS

| | | | | |
|---|---|---|---|---|
| 5,117,264 | A | 5/1992 | Frankel et al. | |
| 5,138,395 | A | 8/1992 | Lindblad et al. | |
| 5,153,657 | A | 10/1992 | Yu et al. | |
| 5,363,182 | A | 11/1994 | Kuribayashi et al. | |
| 5,438,400 | A | 8/1995 | Kuribayashi et al. | |
| 5,450,184 | A | 9/1995 | Yanai et al. | |
| 5,968,656 | A | 10/1999 | Ezenyilimba et al. | |
| 6,238,798 | B1 | 5/2001 | Kang et al. | |
| 6,453,134 | B1 | 9/2002 | Ziegelmuller et al. | |
| 8,170,441 | B2 * | 5/2012 | Ferrar et al. | 399/101 |
| 2007/0244289 | A1 | 10/2007 | Audenaert et al. | |

FOREIGN PATENT DOCUMENTS

| | | |
|---|---|---|
| JP | 91-12316 | 1/1991 |
| JP | 91-12317 | 9/1992 |
| JP | 07-287494 | 10/1995 |

OTHER PUBLICATIONS

U.S. Appl. No. 12/713,205, filed Feb. 26, 2010, titled Cleaning Blade for Electrostatographic Apparatus by Wayne Ferrar et al.
U.S. Appl. No. 12/915,374, filed Oct. 29, 2010, titled Intermediate Transfer Member and Imaging Apparatus and Method by Wayne Ferrar et al.
U.S. Appl. No. 13/117,174, filed May 27, 2011, titled Cleaning Blade Member and Apparatus With Controlled Tribocharging, by Francisco Ziegelmuller et al.

* cited by examiner

*Primary Examiner* — Susan Lee
(74) *Attorney, Agent, or Firm* — J. Lanny Tucker

(57) ABSTRACT

A cleaning blade member includes a polymer substrate and an outermost layer consisting essentially of a non-particulate, non-elastomeric ceramer or fluoroceramer and nanosized inorganic particles that are distributed within the non-particulate ceramer or fluoroceramer in an amount of at least 5 weight % and up to and including 50 weight % of the outermost layer. These cleaning blade members can be used to advantage in apparatus for providing electrophotographic or electrostatographic images.

20 Claims, 4 Drawing Sheets

ELECTROSTATOGRAPHIC CLEANING BLADE MEMBER AND APPARATUS

FIELD OF THE INVENTION

This invention relates to cleaning blade members of the type used, for example, in electrostatographic apparatus to remove toner, carrier particles, dust, lint, and paper debris from a moving surface that is typically in the form of an endless web or drum. In particular, the cleaning blade members have a lower surface energy due to the use of fluorinated ceramer coatings containing nanosized inorganic particles and can be used as either "scraper" blades or "wiper" blades. This invention also relates to apparatus containing the cleaning blade member.

BACKGROUND OF THE INVENTION

The use of cleaning blades is widely practiced in electrostatographic printers and copiers for the removal of toner particles from various moving surfaces (Seino et al. *J. Imag. Sci. & Tech.* 2003, Vol. 47, 424). The portion of the cleaning blade that contacts the surface to be cleaned is generally a polyurethane because such polymers are durable and have a high degree of resilience that is well suited for making contact with a smooth surface.

The use of cleaning (wiper) blades for cleaning webs is described in U.S. Pat. No. 6,453,134 (Ziegelmuller et al.) where the cleaning blades are used to clean transport webs in electrophotographic printers. Toner patches are removed from the transport webs after image density is measured with some type of radiation such as a light emitting diode (LED).

The properties of such cleaning blades can be improved by surface coatings over the polyurethane. For example, U.S. Pat. No. 5,363,182 (Kuribayashi et al.) describes the use of a surface coating of graphite particles in a nylon resin. A primer layer is used to enhance the adhesion of the graphite-containing nylon resin to the polyurethane blade.

Urethane polymers that are designed to be hard like a ceramic yet flexible like a polymer are part of a group of materials known as ceramers. As discussed in U.S. Pat. No. 5,968,656 (Ezenyilimba et al.), ceramers are coated as layers of approximately 5 micrometers on relatively thick, resilient polyurethane substrates or cushion "blanket" cylinders to provide transfer of toner from a photoreceptor to a receiver in electrophotographic printers. One ceramer composition has a urethane backbone made from isophoronone diisocyanate and a polyether diol wherein the backbone is branched by the addition of trimethylolpropane and 1,4-butane diol serves as a chain extender, and the branched urethane is endcapped with 3-isocyanatopropyltriethoxysilane to provide alkoxysilane groups that can react with alkoxysilanes in a sol-gel reaction to form a polyurethane silicate hybrid organic-inorganic composite (OIC) network ceramer.

Urethane polymers containing fluorinated substituents are known. One mode of introduction of the fluorinated component is from a fluoroether, either as an endcapper or from the diol into the polyurethane backbone. U.S. Patent Application Publication 2007/0244289 (Tonge) describes a method of making urethane based fluorinated monomers that can be used to prepare radiation curable coating compositions, and discloses that such monomers can be used to formulate a ceramer composition such as disclosed in U.S. Pat. No. 6,238,798 (Kang et al.) that describes ceramer coating compositions comprising colloidal inorganic oxide particles and a free-radically curable binder precursor which comprises a fluorochemical component that further comprises at least two free-radically curable moieties and at least one fluorinated moiety. In such compositions, the colloidal inorganic oxide particles can be surface treated with a fluoro/silane component that comprises at least one hydrolysable silane moiety and at least one fluorinated moiety. As discussed therein, aggregation of the inorganic oxide particles in such compositions can result in precipitation of such particles or gelation of the ceramer composition, which, in turn, results in a dramatic, undesirable increase in viscosity.

Copending and commonly assigned U.S. Ser. No. 12/713,205 (filed Feb. 26, 2010 by Ferrar, Rimai, Miskinis, and DeJesus) describes cleaning blades having a polymer substrate and fluorinated polyurethane ceramer coatings that provide increased surface modulus with a low surface energy coatings. These improved cleaning blades represent an important advance in the art, but there is a desire to improve cleaning blades with lower surface coefficient of friction and greater durability (longer wear). Moreover, there is a need for cleaning blades with polyurethane substrates to which low coefficient of friction coatings can be applied without intermediate adhering layers, and which cleaning blades can be used for either scraping or wiping in electrostatographic apparatus.

SUMMARY OF THE INVENTION

The present invention provides a cleaning blade member comprising:

a polymer substrate, and disposed upon the polymer substrate, an outermost layer consisting essentially of a non-particulate, non-elastomeric ceramer or fluoroceramer and nanosized inorganic particles that are distributed within the non-particulate ceramer or fluoroceramer in an amount of at least 5 weight % and up to and including 50 weight % of the outermost surface layer.

This invention also provides an apparatus comprising:

a toner-carrying unit, and the cleaning blade member of this invention that is capable of cleaning the toner-carrying unit.

The present invention relates to the use of a non-elastomeric ceramer or fluoroceramer layer comprising nanosized inorganic particles and having a lower coefficient of friction as the outermost layer of a cleaning blade member. Such cleaning blade members can be designed for use as either "scraper" or "wiper" cleaning blade members depending upon the need in the apparatus. The lower coefficient of friction is a result of the incorporation of nanosized inorganic particles ("nanoparticles") into the ceramer or fluoroceramer during the preparation of the composition while it is dissolved in solvent and before it is applied to a polymer substrate. The nanosized inorganic particles generally consist of inorganic oxides that are no larger than about 500 nm and generally present in an amount of at least 5 weight % and up to and including 50 weight % of the outermost layer. A specific example is fumed silica that is dispersed in a solvent and is essentially free of agglomerates that raise the particle size. These are fully formed oxides of the formula corresponding to a silicon dioxide, $SiO_2$. They are different chemically and physically from the partially formed suboxide $SiO_x$ that is formed as a result of the crosslinking chemistry of the polyurethane having terminal reactive alkoxysilane groups with a tetraalkoxysilane compound. The surface roughness is increased on a nanometer length scale by the incorporation of the nanosized inorganic particles, but it is unaffected on the micrometer or larger scale. Thus, examination with a light microscope would fail to differentiate as to whether nanosized inorganic particles had been incorporated into the ceramer or fluoroceramer layer.

As described below, both ceramers and fluoroceramers can be used in the invention. However, fluoroceramer coatings containing nanosized inorganic particles have lower coefficients of friction than similar ceramer coatings. In some embodiments, the polymer substrate comprises a polyurethane such as a silicate hybrid organic-inorganic network formed as a reaction product of a polyurethane having terminal reactive alkoxysilane groups with a tetraalkoxysilane compound.

In other embodiments, the fluorinated polyurethane ceramer coating comprises a fluorinated polyurethane silicate hybrid organic-inorganic network formed as a reaction product of a fluorinated polyurethane having terminal reactive alkoxysilane groups with a tetraalkoxysilane compound and nanosized inorganic particles. This composition provides superior surface quality that is maintained by the nanoparticle-containing fluoroceramer after many hours of use. These factors combine to provide a cleaning blade member outermost layer (outer surface) that has both a low coefficient of friction and superior cleaning properties.

The ceramer or fluoroceramer coating on the cleaning blade member containing the nanosized inorganic particles can extend the life of the cleaning blade member by preventing damage that can occur when the cleaning blade member is used to clean a flexible web, drum, or transport member and to increase its stiffness as well. Defects or damage to a web can cause the cleaning blade member to tear or wear excessively in a single spot but this problem is less likely to occur using the cleaning blade member of this invention.

DETAILED DESCRIPTION OF THE INVENTION

Definitions

As used herein, the term "ceramer" refers to a polyurethane silicate hybrid organic-inorganic network prepared by hydrolytic polymerization (sol-gel process) of a tetraalkoxysilane compound with alkoxysilane-containing organic moieties, which may be a trialkoxysilyl-terminated organic polymer. Further details of such materials are provided in *CAS Change in Indexing Policy for Siloxanes* (January 1995).

The term "fluoroceramer" refers to a material prepared similarly to a ceramer but reacting fluorinated polyurethane having terminal alkoxysilane moieties with a tetraalkoxysilane compound.

Unless otherwise indicated, the terms "cleaning blade member", "cleaning blade", or "blade" refer to embodiments of this invention.

The term "toner-carrying member" refers to a web, drum, belt, or any other component that transports or transfers toner particles or forms toner images using toner particles, or any component on which toner particle debris is found at any stage of an electrostatographic apparatus that uses toner particles to provide an image on a receiver element. For example, such toner-carrying members include but are not limited to, photoconductors, intermediate transfer members (webs or drums), receiver element transport member, and sheet-transfer web.

Unless otherwise indicated, the term "cleaning blades" used in this invention include both "wiper blades" and "scraper blades" as these two terms have become used in the art, e.g. in U.S. Pat. No. 5,991,568 (Ziegelmuller et al.). Thus, the composition comprising a non-particulate, non-elastomeric ceramer or fluoroceramer and nanosized inorganic particles can be used in both wiper blades and scraper blades. See for example U.S. Pat. No. 6,453,154 (noted above) for more details about wiper blades and U.S. Pat. No. 5,991,568 (noted above) for more details about both wiper and scraper blades.

Cleaning Blade Member and Apparatus

Although the cleaning blade member and apparatus of the invention are particularly well adapted for use in an electrostatic printing machine to clean marking particles (toner) and other particulate material from an endless web used to transport image-receiver sheets, it will be evident from the following description that it is equally well suited for use in a wide variety of devices to clean particulate material from different types of moving surfaces, and in particular including other toner-carrying members of an electrostatographic apparatus such as a photoconductive imaging cylinder or belt, an intermediate image-transfer cylinder or belt, sheet-transport web, or a toner image-forming member such as receiver elements.

Figure 1:
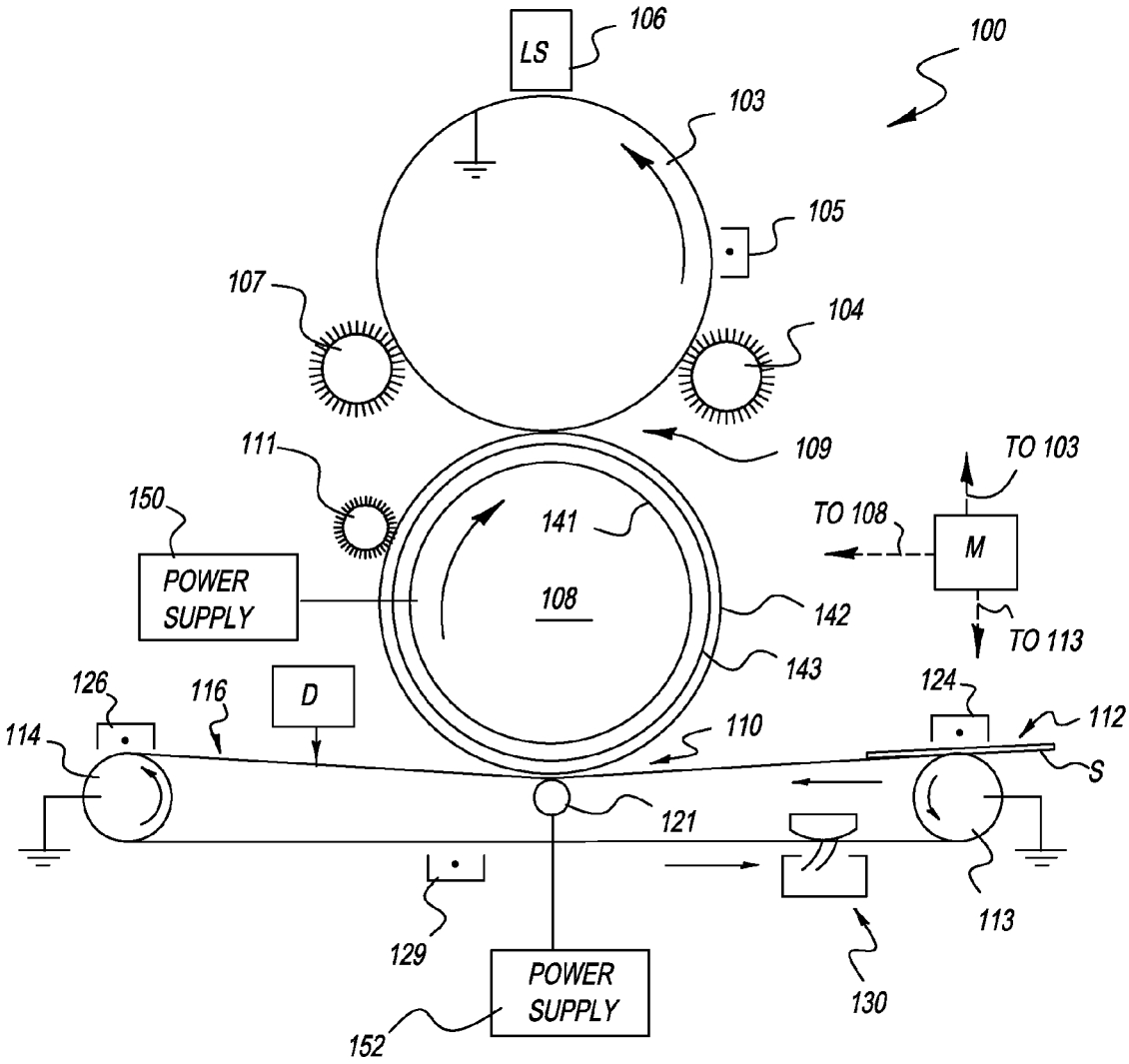
FIG. 1 is a schematic illustration of an electrostatic document printer (apparatus) of this invention containing a cleaning blade member of this invention.

Referring now to FIG. 1, a suitable electrophotographic document printer 100 is shown to include a primary image-forming member 103 (drum), for example, a rotatably driven conductive drum having an outermost layer of a photoconductive material. One or more transferable toner images are formed on the photoconductive surface of primary image-forming member 103 by first uniformly charging the surface with electrostatic charge provided by a corona charger 105. The uniformly charged surface is then imagewise exposed to actinic radiation provided, for example, by a laser scanner 106, thereby selectively discharging the charged surface and leaving behind a latent charge image. Finally, the latent charge image is rendered visible (developed) by applying electroscopic toner particles using a magnetic brush applicator 107. In some printers of this type, a series of toned process control patches (images) are also formed on the surface of the image-forming member, such patches being located in the interframe region between successive image frames.

The above-noted toner images and toned process control patches are then transferred to intermediate transfer member 108 at transfer nip 109. Any residual toner on primary image-forming member 103 is removed by cleaning brush 104 or a cleaning blade member of this invention prior to recycling the image-forming member through the image-forming process. The intermediate transfer member 108 includes, for example, an electrically-conductive drum 141 having a compliant blanket 143 with a relatively hard overcoat 142. The electrically-conductive drum 141 is electrically biased by a power supply 150. The toner images transferred onto intermediate transfer member 108 are then re-transferred to an image-receiver sheet S at a second image-transfer nip 110 formed by a relatively small transfer roller 121 and an endless sheet-transport web 116 made of a dielectric material such as a polymer compound. Sheet-transport web 116 can include a release oil-absorbing porous layer comprising alumina particles in a binder as described in U.S. Pat. No. 7,120,380 (Ferrar et al.) and U.S. Patent Application Publications 2006/0165974 (Ferrar et al.), 2007/0196151 (Ferrar et al.), 2008/0107463 (Ferrar et al.), and 2009/0052964 (Ferrar et al.), all of which are incorporated herein by reference. The toner images are electrostatically attracted to the image-receiver sheets by a suitable electrical bias applied to transfer roller 121 by a power supply 152. Residual toner on intermediate transfer member 108 is removed by a cleaning brush 111 or a cleaning blade member of this invention.

The image-receiver sheets are presented to the endless sheet-transport web 116 at a sheet-feed station 112. Sheet-transport web 116 is trained around a pair of drive rollers 113 and 114, and a motor M serves to drive roller 113 in the direction indicated by the arrow. Motor M also serves to rotatably drive the image-forming and image-transfer drums. The image-receiver sheets (for example paper or plastic sheets) attach to sheet-transport web 116 at corona charging station 124 that operates to charge the top surface of the sheet so that it becomes electrostatically attracted to sheet-transport web 116. Drive rollers 113 and 114, which are grounded, serve to charge to the backside of the sheet-transport web 116. Corona charger 126 operates to detack the image-receiver sheets as they wrap around drive roller 114, thereby freeing the sheets for further transport to a toner fusing station (not shown). Being outside the image frame areas on the image-forming drum, any toned process-control patches transferred to the intermediate transfer member 108 will re-transfer directly to the transport web in the region between successive image-receiver sheets. These toned patches are intended to be removed from the web before receiving a new image-receiver sheet. Otherwise, the toner from these patches could transfer to the rear side of the image-receiver sheets. An electrophotographic document printer of the type shown in FIG. 1 is more thoroughly described in U.S. Pat. No. 6,075,965 (Tombs et al.), the disclosure of which is incorporated herein by reference.

Web-cleaning apparatus 130 is provided for removing not only the random toner particles, dust, and paper debris that can accumulate on the outer surface of sheet-transport web 116 during repeated use of the printer described above, but also any relatively heavy deposits of toner that are transferred to the web, for example, as the result of forming the aforementioned process-control patches on the image-forming drum, paper jams, and mis-registration of a toner image to the image-receiver sheet. As indicated above, such toned patches (designated as TP in FIG. 2) are formed at predetermined locations on the image forming member in the interframe areas and are used, for example, to control registration of multiple color-separated images on the surface of a single image-receiver sheet or to monitor the effectiveness of the image-forming process across the width of the image-forming member. These patches get transferred to the web in the spaces between successive image-receiver sheets and are "read" on the web by a densitometer D located downstream of the second image-transfer nip 110. As will be appreciated, all particles on the sheet-bearing surface of sheet-transport web 116 should be removed or cleaned from the web before the web receives a new image-receiver sheet. The web-cleaning apparatus 130 is particularly well adapted to perform this duty and, as shown, is positioned downstream of transport web conditioning charger 129 that acts to discharge the web surface to facilitate the cleaning function.

Figure 2:
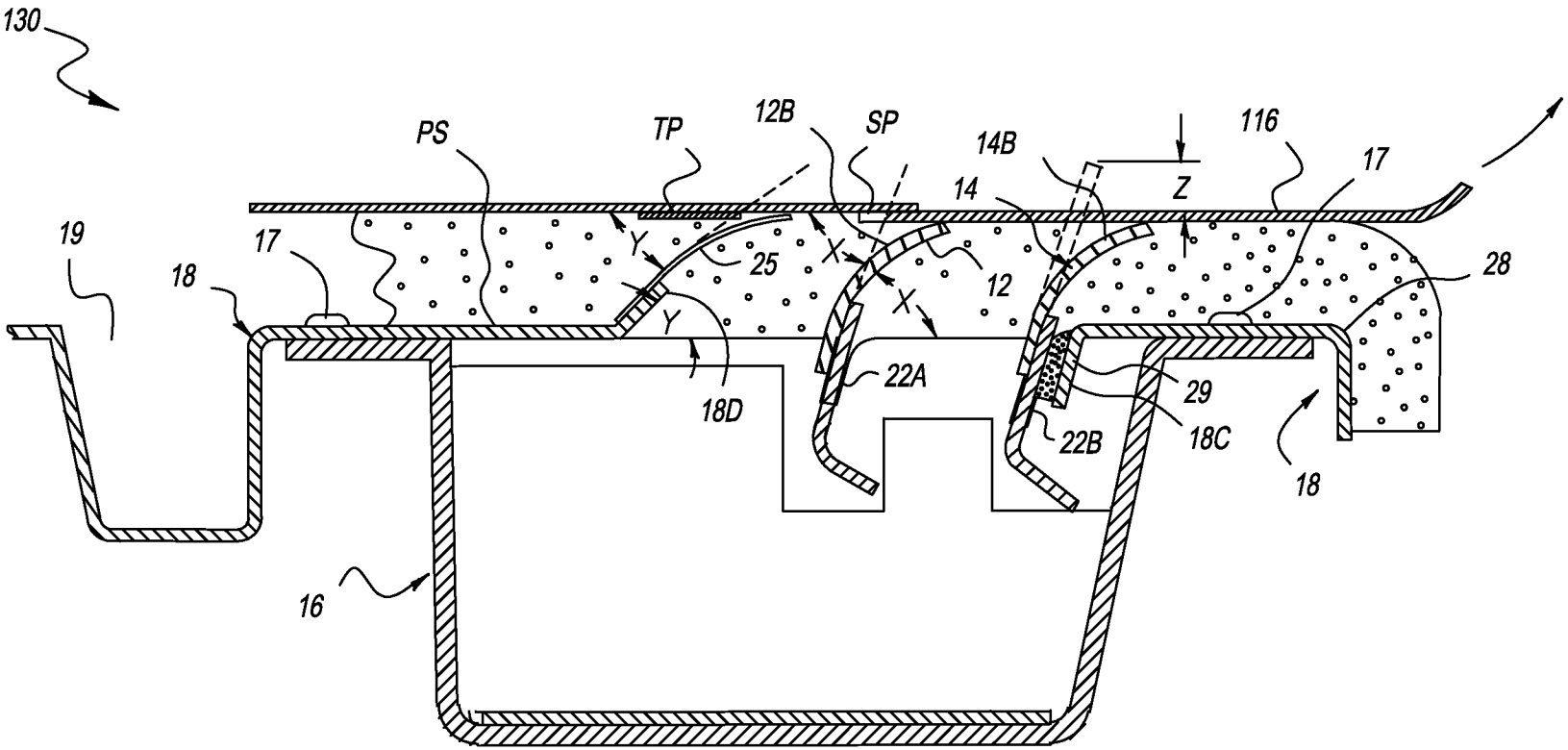
FIG. 2 is a cross-sectional illustration of a web-cleaning apparatus including a cleaning blade member of this invention and such apparatus is shown to be operating on the surface of a sheet-transport web as illustrated in the FIG. 1 apparatus.

Referring to FIG. 2, web-cleaning apparatus 130 is shown including a customer-replaceable cleaning cartridge including a pair of cleaning blade members 12 and 14 that are adapted to contact the outer surface of sheet-transport web 116 and to wipe particulate material there from, a sump housing 16 for releasably supporting cleaning blade members 12 and 14 in a spaced parallel relationship and for receiving and storing particulate material removed or scavenged from the outer surface of web 116 by cleaning blade members 12 and 14, and a multi-purpose lid assembly including lid member 18 attached to the top of sump housing 16 that serves not only to prevent scavenged particles from escaping the edges of sump housing 16, but also to both clean the edges of the web and collect particles deflected from the web by a seal blade (described below) at a location upstream of cleaning blade members 12 and 14.

Figure 3C:
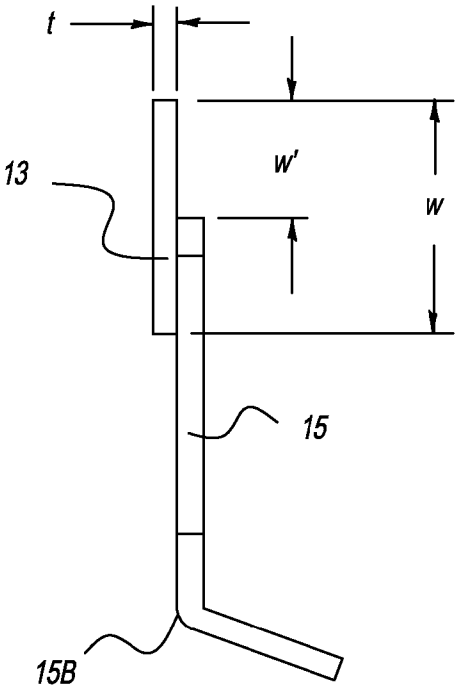
FIGS. 3A, 3B, and 3C are perspective, front, and side elevations of a cleaning blade member of this invention.
Figure 3A:
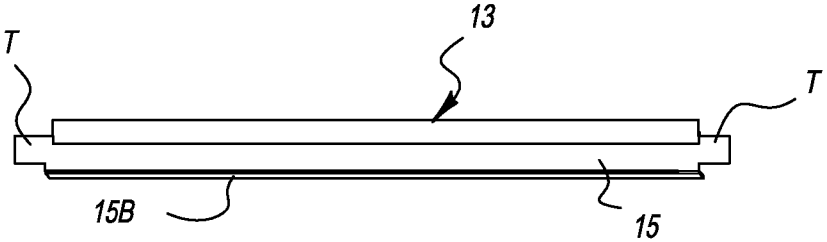
Figure 3B:
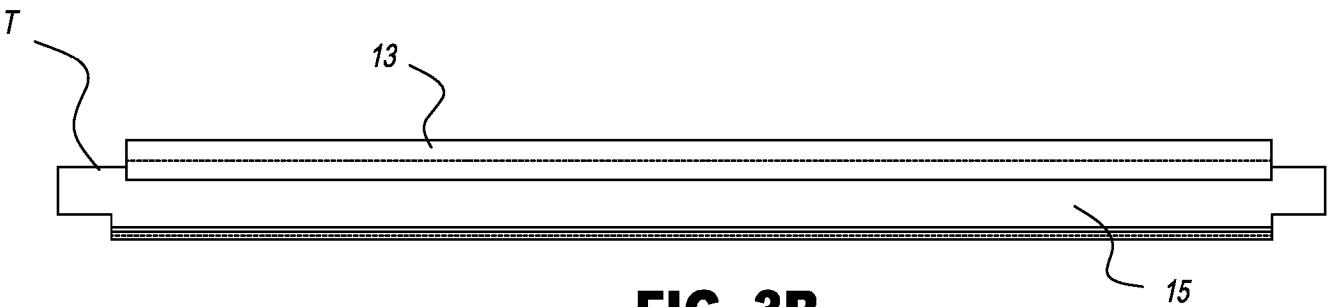

Referring to FIGS. 3A-3C, each of cleaning blade members 12 and 14 comprises a cleaning blade member element 13 and rigid stiffening plate 15. The cleaning blade member element 13 can comprise a rectangular slab of polyester polyurethane with the following properties: a hardness of between 60 and 85 Shore A, an initial modulus of between 500 and 1500 psi, a Bayshore resiliency above 30%, and a compression set lower than 25%. For example, the polyurethane slab can be fabricated with a thickness "t" of about 0.050 inch (0.13 cm) and a width "w" of 0.500 inch (1.27 cm). The length of cleaning blade member element 13 can be equal to the width of sheet-transport web 116. For example, the cleaning blade members extend at least 12 mm and up to and including 25 mm beyond each of the edges of the widest image-receiver sheet size but within the web width. The polyurethane slab is glued to rigid stiffening plate 15, the latter typically being made of steel, so as to produce a free extension "w'" of 0.250 inch (0.635 cm) (see FIG. 3C). In general, the ratio of the polyurethane thickness to the free extension should be at least 0.125 and up to including 0.250. As shown, the steel rigid stiffener plate 15 is provided with a bend 15B along one edge thereof, thereby giving the plate a somewhat L-shaped cross-section. The purpose of the bend 15B is to reduce any bending tendency of stiffening plate 15 along its length. The bend angle is typically between 90° and 150°, and it should be such as not to provide a barrier to particle flow into the sump housing 16. A pair of opposing extension tabs T is provided on each rigid stiffening plate 15 for mounting the cleaning blade members 12 and 14 on the sump housing 16. Opposing extension tabs T are designed so that they rest on the respective bottom surfaces of a pair of supporting notches formed in the sump housing side walls, as described below. When so seated, cleaning blade members 12 and 14 are in a locked position relative to the direction of motion of the sheet-transport web 116. In accordance with the present invention, cleaning blade member element 13 is coated with a ceramer or fluoroceramer coating surface layer described below.

Sump housing 16 comprises a generally rectangular tray, typically made of plastic and injection-molded, that defines a reservoir for receiving particulate material removed from web 116. The tray has a pair of opposing side walls, each defining a pair of notches, for example notches 22A and 22B (FIG. 2). As indicated above, these notches are shaped to support the extension tabs T extending axially from the respective ends of cleaning blade members 12 and 14. The notches are so located and oriented in the side walls so as to support the two cleaning blade members 12 and 14 in a spaced, parallel relationship, with cleaning blade member elements 12B and 14B being arranged at an acute angle X relative to the upper planar surface PS of a lid member 18 and to the oncoming web surface (that is, the upstream portion of the web). Thus, cleaning blade member elements 12B and 14B will be supported in a "wiping" mode. Cleaning blade members 12 and 14 are installed by simply dropping the extension tabs T of cleaning blade members 12 and 14 into notches 22A and 22B of the sump housing 16. Thus, the cleaning blade members are removed by simply lifting them out of their supporting notches. The blade-supporting notches are arranged so as to produce a predetermined and desired wiping angle and interference with the surface to be cleaned. Typically, the wiping angle is between 60° and 85° and, most likely, about 80°. The amount of blade interference Z with the web surface depends on the stiffness of the cleaning blade member and the desired load to clean. In general, this interference can be between 0.010 inch to 0.100 inch (0.025 cm to 0.25 cm) and is, typically, between 0.010 inch and 0.060 inch (0.025 cm to 0.15 cm), and a normal load is within the range of from 10 to 60 g/cm. The first blade can be set at a lower load so as to function primarily as the cleaner of the bulk of the toned patches and a trapper of lint, paper dust, and oil, and the second blade can be set at a higher load to complete the cleaning operation. This result can be achieved by making adjustments to cleaning blade members 12 and 14 (for example, by varying the thickness t, width w, or material of the cleaning blade member elements 12B and 14B) or by varying the depth of the blade-supporting notches in sump housing 16. It can be desired that both cleaning blade members 12 and 14 be set at the same load. A desired spacing between cleaning blade members 12 and 14 is between 0.250 inch and 0.750 inch (0.64 cm and 1.91 cm) to reduce any chance of toner spilling while allowing enough room for particles to flow down into sump housing 16.

Lid member 18 cooperates with sump housing 16 to provide a substantially enclosed chamber for particulate material scavenged from the web. Lid member 18 can be fabricated from a static dissipative plastic material. It can, however, alternatively be made of a light weight metal, such as aluminum. Lid member 18 can be designed to snap onto the top of sump housing 16. Alternatively, it can be rigidly connected to sump housing 16 by suitable fasteners 17.

Lid member 18 has a substantially planar surface PS in which a substantially rectangular opening is formed. Cleaning blade member elements 12B and 14B of cleaning blade members 12 and 14 project though the opening when cleaning blade members 12 and 14 are seated in sump housing 16. Flange 18C extends downwardly from the downstream edge of the opening and serves to provide backup support for foam seal 29 located behind cleaning blade 14. Seal 29 (for example of foam) operates to seal the downstream end of the cartridge from loss of scavenged particles through the opening. Seal 29 does not contact moving web 116 and it can be separated from web 116 by at least 0.075 inch (0.191 cm) to prevent possible toner recontamination due to slight build up of toner from the collisions of cleaning blade member elements 12B and 14B with splice SP in web 116.

Second flange 18D extending upwardly from the upstream edge of the opening at an angle Y serves to support a thin, flexible seal blade 25 that projects upwardly from lid member 18, generally towards the cleaning blade member 12. In addition to sealing the upstream end of the cartridge from a loss of scavenged particles during use, flexible seal blade 25 also acts to deflect particles wiped from the web by cleaning blade member 12 toward and through the lid opening and ultimately into underlying sump housing 16. The gap between the free edge of flexible seal blade 25 and first cleaning blade member 12 is relatively narrow, for example between 0.150 inch and 0.750 inch (0.38 and 1.91 cm) in width to reduce any chance of scavenged particle spillage or leakage. Flexible seal blade 25 is relatively thin (for example, less than 0.004 inch or 0.01 cm) and extends at a relatively shallow angle Y between 15° and 30° relative to the web surface. At such an angle, flexible seal blade 25 has minimal effect on scavenging particulate material from web 116. The seal blade dimensions are selected to reduce waviness in the blade edge. Several materials are desired, including polyesters, nylon, polycarbonate, and polyethylene, and the thickness of flexible seal blade 25 is generally less than 0.0025 inch (0.006 cm). The free extension of flexible seal blade 25 (the part that extends beyond the edge of tab 18D) is generally less than 1 inch (2.54 cm) to reduce waves but more than 0.100 inch (0.25 cm) to maintain a flexibility that prevents particle scavenging. The desired range of free extension is between 0.300 inch and 0.600 inch (0.76 cm to 1.52 cm). The forward end of lid member 18 can be shaped to define an elongated cavity 19 that extends across the entire width of the lid and operates as an auxiliary external sump adapted to collect and contain any particulate material that is deflected from web 116 upstream of the intended web-cleaning location (for example, by flexible seal blade 25).

A seal can be attached to lid member 18 at both sides of sump housing 16. These seals serve both to reduce any leakage of scavenged particles out of the sides of the sump during use of the cartridge, and to wipe particles from the sides of sheet-transport web 116. Each seal has an adhesive on the side facing the lid member 18 and a wear-resistant fabric, for example Nylon, on the side facing sheet-transport web 116. These seals reduce any leakage of scavenged particles from the sides of the sump during use of the cleaning apparatus. The foam portion of the seal needs to be of high resiliency, low density, and a low compression set to maintain an effective seal and to reduce any drag torque on sheet-transport web 116. A useful foam material is R200/U polyester having a density of 2 lb/cm$^3$ (0.91 kg/cm$^3$). The Tricot fabric also serves to reduce friction between the web surface and the seal and it provides some cleaning of the web surface not covered by cleaning blade members 12 and 14.

A cleaning blade member of this invention, which is used as a wiper blade, can also be incorporated into an apparatus so that the angle between a tangent to the surface to be cleaned in front of the cleaning blade member cleaning edge and a blade holder bracket holding the cleaning blade member in the apparatus is at least 60° and up to and including 85°.

The cleaning blade member comprises a polymer substrate upon which the outermost surface layer is directly disposed. Polyurethane is polymer useful as a substrate. It is known for its toughness and ability to be tailored to various degrees of hardness (Shore A). Other polymers that are useful as substrates include but are not limited to, polyamideimides, fluorinated resins such as poly(vinylidene fluoride) and poly (ethylene-co-tetrafluoroethylene), vinyl chloride-vinyl acetate copolymers, ABS resins, and poly(butylene or terephthalate). Mixtures of the noted resins can also be used. These resins can also be blended with elastic materials and can also include other additives including antistatic agents. The cleaning blade member substrate can have a thickness of at least 0.85 mm and up to and including 2.5 mm, and a width of at least 10 mm and up to and including 20 mm to fabricate cleaning blade members with a free length of at least 5 mm and up to and including 12 mm, depending upon the desired load against the material to be cleaned.

The outermost layer is disposed directly on the substrate meaning that there are no intermediate layers. The outermost surface layer (also known as an "overcoat") consists essentially of a non-particulate, non-fluorinated ceramer or fluoroceramer and nanosized inorganic particles. Thus, this outermost surface layer contains no other needed components for toner transfer and any additives (such as antioxidants, colorants, or lubricants) are optional. The outermost surface layer is generally transparent and has an average thickness, in dry form, of at least 1 μm and up to and including 20 μm, or typically at least 1 μm and up to and including 15 μm, or even at least 1 μm and up to 12 μm.

The outermost surface layer generally has a Young's modulus of at least 50 MPa and up to and including 2000 MPa. This Young's modulus does not appear to be affected by the presence of the nanosized inorganic particles. Surprisingly, ceramers and fluoroceramers having high amounts of alkoxysilane crosslinker and high amounts of nanosized inorganic particles do not readily crack.

The outermost surface layer has a measured storage modulus of at least 0.1 GPa and up to and including 2 GPa, or typically at least 0.3 GPa and up to and including 1.75 GPa, or still again at least 0.5 GPa and up to and including 1.5 GPa, when measured using a Dynamic Mechanical Analyzer (DMA).

In addition, the outermost surface layer has a dynamic (kinetic) coefficient of friction of less than 0.5 or typically less than 0.4, as measured using a model 3M90 slip-peel tester from Analogic Measurometer II (Instrometers, Inc.). Strips of the fluoroceramer coated polyurethane substrate were attached to a weighted sled that was pulled over a photoconductor film on a horizontal surface while contacting the fluoroceramer coating and a load cell is used to measure the force needed to move the sled. The static and dynamic (kinetic) coefficients of friction were then calculated.

In addition, the outermost surface layer generally has an average surface roughness Ra of less than 50 nm, as measured by Atomic Force Microscopy (AFM).

The ceramer used in the outermost surface layer generally comprises a polyurethane silicate hybrid organic-inorganic network formed as a reaction product of a non-fluorinated polyurethane having terminal reactive alkoxysilane moieties with a tetrasiloxysilane compound. More typically, the polyurethane with terminal alkoxysilane groups is the reaction product of one or more aliphatic, non-fluorinated polyols having terminal hydroxyl groups and an alkoxysilane-substituted alkyl-substituted isocyanate compound. Suitable aliphatic polyols have molecular weights of at least 60 and up to and including 8000 and can be polymeric in composition. Polymeric aliphatic polyols can further include a plurality of functional moieties such as an ester, ether, urethane, non-terminal hydroxyl, or combinations of these moieties. Polymeric polyols containing ether functions can also be polytetramethylene glycols having number average molecular weights of at least 200 and up to and including 6500, which can be obtained from various commercial sources. For example, Terathane™-2900, -2000, -1000, and -650 polytetramethylene glycols that are available from DuPont, are useful in the reactions described above.

Polyols having a plurality of urethane and ether groups are obtained by reaction of polyethylene glycols with alkylene diisocyanate compounds having 4 to 16 aliphatic carbon atoms, such as 1,4-diisocyanatobutane, 1,6-diisocyanatohexane, 1,12-diisocyanatododecane, and isophorone diisocyanate [5-isocyanato-1-(1-isocyanatomethyl)-1,3,3-trimethylcyclohexane). The reaction mixture can also include monomeric diols and triols containing 3 to 16 carbon atoms, and the triols can provide non-terminal hydroxyl substituents that provide crosslinking of the polyurethane. For example, a polymeric polyol can be formed from a mixture of isophorone diisocyanate, a polytetramethylene glycol having a number average molecular weight of about 2900, 1,4-butanediol, and trimethylolpropane in a suitable molar ratio.

The noted reactions are generally promoted with a condensation catalyst such as an organotin compound including dibutyltin dilaurate. The polyurethane having terminal reactive alkoxysilane moieties, is further reacted (acid catalyzed) with a tetraalkoxysilane compound to provide a ceramer useful in the present invention. The molar ratio of aliphatic polyol:alkoxysilane-substituted alkyl isocyanate is generally from about 4:1 to about 1:4, or from about 2:1 to about 1:2.

Further details about useful aliphatic hydroxyl-terminated polyols and alkoxy-substituted alkyl isocyanate compounds are described in U.S. Pat. No. 5,968,656 (noted above). This patent also shows a general network of the ceramer (Col. 5-6).

The fluorinated polyurethane ceramer coatings used in the present invention are advantageous because they have a low surface energy characteristic from a fluorinated moiety incorporated into the polyurethane with the durability imparted by the inorganic phase of the ceramer. Other advantages are low coefficient of friction, nonflammability, low dielectric constant, and high solvent and chemical resistance. Fluorinated ethers were incorporated into polyurethanes as described in U.S. Pat. No. 4,094,911 (Mitsch et al.).

The fluorinated polyurethane ceramer generally comprises the reaction product of a fluorinated polyurethane silicate hybrid organic-inorganic network formed as a reaction product of a fluorinated polyurethane having terminal reactive alkoxysilane moieties with a tetraalkoxysilane compound, and can be prepared by incorporating fluorinated ethers into the polyurethane backbone before it is end-capped with the isocyanatopropyltrialkoxysilane in the preparation of a polyurethane silicate hybrid organic-inorganic network as described in U.S. Pat. No. 5,968,656 (noted above) as illustrated in Scheme 1 below. In such embodiments, the polyurethane with terminal alkoxysilane groups is the reaction product of one or more fluorinated aliphatic polyols having terminal hydroxyl groups, at least one comprising a fluorinated polyol as further discussed below, optionally one or more non-fluorinated aliphatic polyols having terminal hydroxyl groups, and an alkoxysilane-substituted alkyl isocyanate compound. Suitable aliphatic polyols typically have molecular weights of at least 60 and up to and including 8000 and can be polymeric. Polymeric aliphatic polyols can further include a plurality of functional moieties such as an ester, ether, urethane, non-terminal hydroxyl, or combinations thereof. Polymeric polyols containing ether functions can be polytetramethylene glycols having number-average molecular weights at least 200 and up to and including 6500, which can be obtained from various commercial sources. For example, Terathane™-2900, -2000, -1000, and -650 polytetramethylene glycols having the indicated number-average molecular weights are available from Invista.

Polymeric polyols containing a plurality of urethane and ether groups can be obtained by reaction of fluorinated polyols and non-fluorinated polyols (such as polyethylene glycols) with alkylene diisocyanate compounds containing about 4 to 16 aliphatic carbon atoms, for example, 1,4-diisocyanatobutane, 1,6-diisocyanatohexane, 1,12-diisocyanatododecane, and, preferably, isophorone diisocyanate (5-isocyanato-1-(isocyanatomethyl)-1,3,3-trimethylcyclohexane). The reaction mixture can further include monomeric diols and triols containing 3 to about 16 carbon atoms as the triol compounds provide non-terminal hydroxyl substituents that provide branching of the polyurethane. In some embodiments, a polymeric polyol is formed from a mixture of isophorone diisocyanate, a polytetramethylene glycol having a number-average molecular weight of about 650, a fluoroalkoxy substituted polyether polyol having a number-average molecular weight of about 6300, 1,4-butanediol, and trimethylolpropane in a molar ratio of about 9:3:0.1:5:1.

Reaction of the aliphatic polyol having terminal hydroxyl groups with an alkoxysilane-substituted alkyl isocyanate compound, which can be promoted by a condensation catalyst, for example, an organotin compound such as dibutyltin dilaurate, provides a polyurethane having terminal reactive alkoxysilane moieties, which undergoes further reaction, such as an acid-catalyzed reaction, with a tetraalkoxysilane compound to provide a useful fluoroceramer. The molar ratio of aliphatic polyol:alkoxysilane-substituted alkyl isocyanate can be from 4:1 to 1:4 or more typically from 2:1 to 1:2.

Aliphatic hydroxyl-terminated polyols used in the preparation of the fluoroceramers can be of the general formula $$HO—R^1—OH$$

and can have molecular weights of at least 60 and up to and including 8000. As previously noted, at least one polyol is usually polymeric, and $R^1$ can include a plurality of ester, ether, urethane, and non-terminal hydroxyl groups.

The alkoxysilane-substituted alkyl isocyanate compound generally has the formula $$OCN—R^2—Si(OR^3)Z^1Z^2$$

wherein $R^2$ is an alkylene group having from 2 to 8 carbon atoms, $OR^3$ is an alkoxy group having 1 to 6 carbon atoms, and $Z^1$ and $Z^2$ are independently alkoxy groups having 1 to 6 carbon atoms, hydrogen, halo, or hydroxyl groups. More typically, $R^2$ has 2 to 4 carbon atoms, and $OR^3$, $Z^1$, and $Z^2$ are each alkoxy groups having 1 to 4 carbon atoms. A useful alkoxysilane-substituted alkyl isocyanate compound is 3-isocyanatopropyl-triethoxysilane.

Tetraalkoxysilanes act as crosslinkers for the trialkoxysilane-functionalized urethanes and fluorourethanes and also form filler particles of silicon suboxide, $SiO_x$. The tetraalkoxysilane compound can be tetramethyl orthosilicate, tetrabutyl orthosilicate, tetrapropyl orthosilicate, or more typically, tetraethyl orthosilicate ("TEOS").

The hybrid organic-inorganic network of the fluoroceramer used in the outermost surface layer of the cleaning blade member has the general structure as illustrated in Col. 5 of U.S. Pat. No. 5,968,656 wherein $R^1$ and $R^2$ are as previously defined, with the proviso that at least a portion of the $R^1$ groups include a fluorinated moiety. The hybrid organic-inorganic network includes at least 10 weight % and up to and including 80 weight % and more typically at least 25 weight % and up to and including 65 weight %. The fluorinated moiety in such ceramer can be conveniently obtained wherein the aliphatic hydroxyl-terminated polyol (such as a polyether diol) employed in formation of a non-fluorinated ceramer is partially replaced with the fluorinated ether to incorporate the low surface energy component into the polymer backbone. Full replacement of the aliphatic hydroxyl-terminated polyol with the fluorinated diol is generally not desirable as the surface properties do not change a great deal after the fluoropolymer accounts for more than about 20 weight % of the end capped polymer, also known as the "masterbatch."

A number of fluoroethers are available commercially that are suitable for use in this invention. In general the dihydroxy terminated fluoroalcohols are desired because they can be polymerized directly into the urethane polymer. The use of monohydroxyfluoroalcohols is not desirable because the end groups of the ceramer masterbatch should ideally contain trialkoxysilane functionality for subsequent reaction with the sol-gel precursors. The monomers should generally be diols or triols.

One class of macromers with a perfluoropolyethere chain backbone and diol end groups is Fluorolink D10 and D10-H available from Solvay Solexis in Italy. The same fluorocarbon structure but with the hydroxy end groups attached to ethylene oxide repeat units is also available from the same vendor as Fluorolink E10-H. These macromers are between 500-700 average equivalent weights.

$$HO—CH_2—CF_2—O—(CF_2—CF_2—O)_p—(CF_2—O)_q—CF_2—CH_2—OH$$

Fluorolink D10 and D10-H $$HO—(CH_2—CH_2—O)_n—CH_2—CF_2—O—(CF_2—CF_2—O)_p—(CF_2—O)_q—CF_2—CH_2—(O—CH_2—CH_2)_n—OH$$

Fluorolink E10 and E10-H

Generally higher molecular weights are desired to improve the mechanical properties of the urethane, such as ZDOLTX from Ausimont, Bussi, Italy with a number average molecular weight of 2300 and polydispersity of 1.6. Incorporation of these fluorinated blocks into polyurethanes can improve the chemical resistance and lower the coefficients of friction of thermoplastics with fluorine rich surfaces on materials with low fluorine content.

The dihydroxyfluoroethers are described in a report from the Department of Energy DOE/BC/15108-1 (OSTI ID: 750873) Novel $CO_2$-Thickeners for Improved Mobility Control Quarterly Report Oct. 1, 1998-Dec. 31, 1998 by Robert M. Enick and Eric J. Beckman from the University of Pittsburgh and Andrew Hamilton of Yale University, published February 2000 (http://www.osti.gov/bridge/servlets/purl/750873-KDMj2Z/webviewable/750873.pdf). Also described is the commercially available difunctional isocyanate terminated fluorinated ether Ausimont Fluorolink B. This urethane precursor has an average molecular weight of 3000 g/mol and a structure:

$$OCN—Ar—OCCF_2O(R^1)p(R^2)qCF_2CONH—Ar—NCO.$$

In these structures, $R^1$ is $CF_2CF_2O$, $R^2$ is $CF_2O$, and Ar is an aromatic group. In both fluorinated macromonomers, the difunctional contents are greater than 95% as characterized by NMR analysis. Ausimont describes both compounds as polydisperse.

Similar fluoroethers are also available from Aldrich Chemical (Milwaukee, Wis.) including multifunctional blocks. Such compounds include:

Poly(tetrafluoroethylene oxide-co-difluoromethylene oxide) α,ω-diol, $HOCH_2CF_2O(CF_2CF_2O)_x(CF_2O)_yCF_2CH_2OH$, average $M_n \approx 3800$;

Poly(tetrafluoroethylene oxide-co-difluoromethylene oxide) α,ω-diol bis(2,3-dihydroxypropyl ether), $HOCH_2CH(OH)CH_2OCH_2CF_2O(CF_2CF_2O)_x(CF_2O)_yCF_2CH_2OCH_2CH(OH)CH_2OH$, average $M_n \approx 2000$;

Poly(tetrafluoroethylene oxide-co-difluoromethylene oxide) α,ω-diol, ethoxylated $HO(CH_2CH_2O)_xCH_2CF_2O(CF_2CF_2O)_y(CF_2O)_zCF_2CH_2(OCH2CH_2)_xOH$, average $M_n \leq 2200$; and Poly(tetrafluoroethylene oxide-co-difluoromethylene oxide) α,ω-diisocyanate, $CH_3C_6H_3(NCO)NHCO_2(CF_2CF_2O)_x(CF_2O)_yCONHC_6H_3(NCO)CH_3$, average $M_n \approx 3000$.

Also suitable are PolyFox® Fluorochemicals from OMNOVA Solution Inc. (Fairlawn, Ohio) having the following structures:

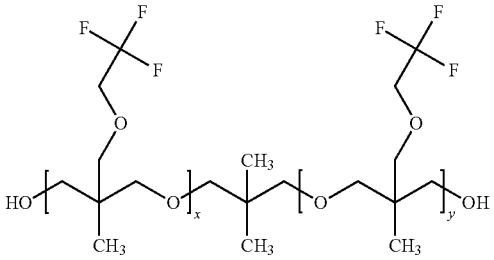

PolyFox PF-636 x + y = 6
PolyFox PF-6320 x + y = 20

-continued

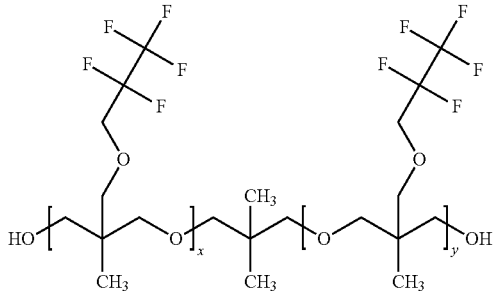

PolyFox PF-656 x + y = 6
PolyFox PF-6520 x + y = 20

These materials are thought to be more environmentally friendly than other fluorocarbons because these have only short fluorocarbon side chains.

The incorporation of the fluoromonomer can be represented as shown below in Scheme

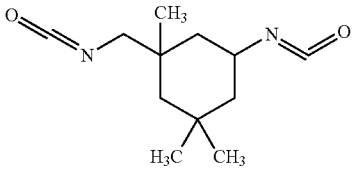

isophoronone diisocyanate

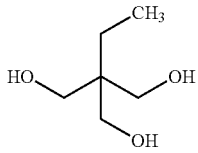

trimethylolpropane

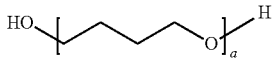

Terethane$^R$ 2900 a≈40

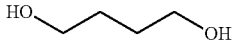

1,4-butane diol tin catalyst
THF Δ 24 h

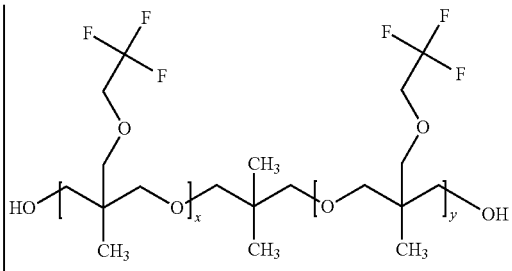

PolyFox PF-6320 x + y = 20

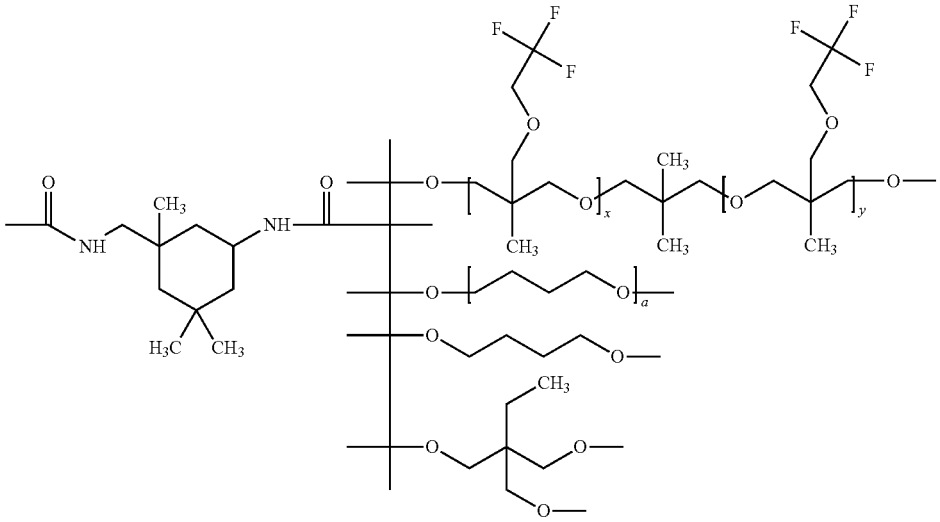

-continued urethane ceramer masterbatch

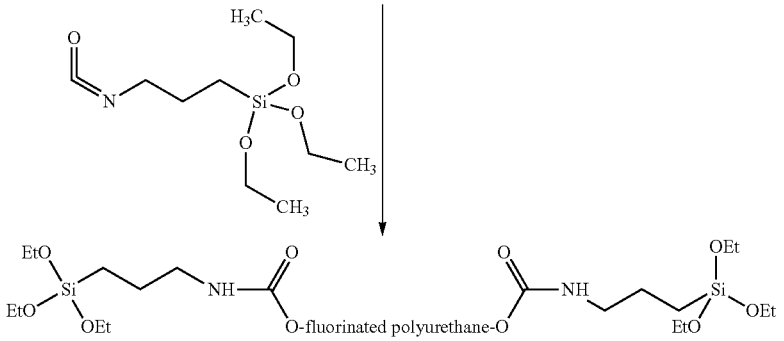

Triethoxysilane endcapped urethane

In the Examples described below, the triethoxysilane endcapped fluorinated polyurethane was allowed to react with tetraethoxyorthosilicate (TEOS) in the presence of acid and water to hydrolyze and condense the siloxane into a silsesquioxane network. These materials were coated on nickelized PET and cured overnight at 80° C. to form a polyurethane silicate hybrid organic-inorganic network.

Trialkoxyfluorosilanes can also be used to introduce fluorinated alkyl groups into the fluoroceramer. The carbon-silicon bond is stable in both acid and base. These bonds are unlike the hydrolyzable silicon-oxygen of the silicon alkoxides that cleave and form the condensation products of the fluoroceramer. Thus, in the same way, the end capped fluorourethane will be incorporated into the fluoroceramer product, so too will be the fluoroalkyl moiety that is part of an alkyltrialkoxysilane. Many silanes are available commercially including nonafluorohexyltriethoxysilane, nonafluorohexyltrimethoxysilane, (heptadecafluoro-1,1,2,2-tetrahydrodecyl)triethoxysilane, and (heptadecafluoro-1,1,2,2-tetrahydrodecyl)trimethoxysilane. Additionally, more reactive groups can be used in place of the alkoxy groups. For example, both chloro and amino groups will hydrolyze from the silicon atom in the presence of alcohol or water. An example of the fluoroalkylsilane with hydrolyzable chloro functionality is (heptadecafluoro-1,1,2,2-tetrahydrodecyl) trichlorosilane. The condensation of trihydroxy-substituted silicon atoms that contain an alkyl group are known as silsesquioxanes, and are sometimes represented by the formula $RSiO_{1.5}$, which would describe the product of the derivatized fluorinated urethane if TEOS is replaced with the trialkoxysilane. Mixing TEOS with the fluorinated trialkoxysilane would produce a material somewhere between a silsesquioxane and a ceramer. Additionally, a certain level of di- or monohydrolysable fluoroalkylsilane can be used to incorporate fluorinated groups into the fluoroceramer. These include heneicosafluorododecyltrichlorosilane and (heptadecafluoro-1,1,2,2-tetrahydrodecyl)methyldichlorosilane.

The ceramer or fluoroceramer comprises at least 10 weight % and up to and including 95 weight %, or typically at least 60 weight % and up to and including 80 weight %, of the outermost surface layer. Mixtures of either or both ceramers and fluoroceramers can be used if desired.

Distributed within the outermost surface layer are nanosized inorganic particles. By "nanosized", we mean the particles have a average largest dimension of at least 1 nm and up to and including 500 nm, or typically of at least 10 nm and up to and including 100 nm so that the particles disrupt the surface to a very limited extent (little effect on surface roughness), for example when the outermost surface layer has an average thickness of less than 10 μm. The small nanosized inorganic particles also provide clear coatings that are relatively transparent to light that can be an advantage for densitometry readings of toner particles on the intermediate transfer member. These particles can be present in any desirable size and shape but generally, they are essentially spherical. However, elongated, acircular, plate-like, or needle-like particles are also useful. The average particle size can be determined by light scattering and electron microscopy.

Particularly useful inorganic particles are metal oxides such as alumina or silica particles, for example spherical silica or alumina particles. Mixtures of alumina and silica particles can be used if desired. In some embodiments, the inorganic particles are triboelectrically charging metal oxide particles. Useful inorganic particles can be readily obtained from several commercial sources. Silica particles that are not agglomerated to large secondary particles are available in solvents such as water, various alcohols, and methyl ethyl ketone (MEK) that is also known as 2-butanone. These particles are available from Nissan Chemical of America in Texas as ORGANOSILICASOL™ colloidal silica mono-dispersed in organic solvent.

Dispersions of agglomerated alumina can also be prepared from dry powders such as gamma-alumina. These agglomerates can be broken down into nanosized inorganic particles that are stable in different solvents using various types of milling achieve different particle sizes, including ball milling and media milling. High quality gamma-alumina powders that can be milled into stable, translucent dispersions are available from Sasol of Americal in Houston, Tex.

The nanosized inorganic particles are generally present in the outermost surface layer in an amount of at least 5 weight % and up to and including 50 weight % of the total solids of the outermost surface layer. More likely, the nanosized inorganic particles are present in an amount of at least 10 weight % and up to and including 40 weight % of the outermost surface layer.

As noted above, the cleaning blade member of this invention can be incorporated into a suitable apparatus that can be used for electrostatic or electrostatographic imaging, and used for the intended purpose described above.

Besides the specific apparatus described in FIG. 1, more generally, such an apparatus for providing an electrostatographic image includes at least a toner-image forming unit that uses a developer containing a toner to form a toner image on a toner image carrier (such as a photoconductor), and the intermediate transfer member (drum or web). Other components or stations are often present as one skilled in the art would readily understand. Representative apparatus in which the cleaning blade member of this invention can be incorporated are described for example, in U.S. Pat. No. 5,666,193 (Rimai et al.), U.S. Pat. No. 5,689,787 (Tombs et al.), U.S. Pat. No. 5,985,419 (Schlueter, Jr. et al.), U.S. Pat. No. 5,714,288 (Vreeland et al.), U.S. Pat. No. 6,548,154 (Stanton et al.), U.S. Pat. No. 6,694,120 (Ishii), U.S. Pat. No. 7,728,858 (Hara et al.), and U.S. Pat. No. 7,729,650 (Tamaki), U.S. Patent Application Publications 2004/0247347 (Kuramoto et al.), 2009/0250842 (Okano), 2009/0074478 (Kurachi), and 2009/0074480 (Suzuki), and EP 0 747 785 (Kusaba et al.), all incorporated herein by reference to show apparatus features.

For example, the toner-image forming unit can have a charging device that produces electric charge on the toner image carrier, an exposure device that forms an electrostatic latent image on the image carrier, and a developing device that develops the electrostatic latent image with the developer containing the toner to form a toner image.

In addition, the apparatus can further comprise a receiver element device that can hold receiver elements (such as sheets of paper) to which the toner image can be transferred from the intermediate transfer member. The intermediate transfer member in this apparatus can be an endless belt.

Further, the apparatus can further comprise a fixing unit for fixing the toner image on a receiver element.

In simple terms, a toner image on a receiver element can be formed by:

forming an electrostatic latent image on an image carrier, developing the latent image with a dry developer comprising toner particles to form a toner image, transferring the toner image to an intermediate transfer member (for example an endless belt), and transferring the toner image from the intermediate transfer member to a receiver element in the presence of an electric field that urges the movement of the toner image to the receiver element.

Dry developers are well known in the art and typically include carrier particles and toner particles containing a desired pigment.

This method can further comprise fixing the toner image on the receiver element.

The present invention provides at least the following embodiments and combinations thereof, but other combinations of features are considered to be within the present invention as a skilled artisan would appreciate from the teaching of this disclosure:

1. A cleaning blade member comprising:

a polymer substrate, and disposed upon the polymer substrate, an outermost layer consisting essentially of a non-particulate, non-elastomeric ceramer or fluoroceramer and nanosized inorganic particles that are distributed within the non-particulate ceramer or fluoroceramer in an amount of at least 5 weight % and up to and including 50 weight % of the outermost surface layer.

2. The cleaning blade member of embodiment 1 wherein the inorganic particles have an average largest dimension of at least 1 nm and up to 500 nm.

3. The cleaning blade member of embodiment 1 or 2 wherein the inorganic particles have an average largest dimension of at least 10 nm and up to and including 100 nm.

4. The cleaning blade member of any of embodiments 1 to 3 wherein the inorganic particles are silica or alumina particles.

5. The cleaning blade member of any of embodiments 1 to 4 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound.

6. The cleaning blade member of embodiment 5 wherein the ceramer polyurethane having terminal alkoxysilane groups comprises the reaction product of one or more aliphatic non-fluorinated polyols having terminal hydroxyl groups and an alkoxysilane alkyl-substituted isocyanate compound, and the fluoroceramer polyurethane having terminal alkoxysilane groups comprises the reaction product of one or more fluorinated aliphatic polyols having terminal hydroxyl groups, one or more non-fluorinated aliphatic polyols having terminal hydroxyl groups, and an alkoxysilane alkyl-substituted isocyanate compound.

7. The cleaning blade member of any of embodiments 1 to 6 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound, wherein the tetraalkoxysilane compound is tetramethyl orthosilicate, tetrabutyl orthosilicate, tetrapropyl orthosilicate, or tetraethyl orthosilicate.

8. The cleaning blade member of any of embodiments 1 to 7 wherein the ceramer comprises a polyurethane silicate hybrid organic-inorganic network formed as a reaction product of a non-fluorinated polyurethane having terminal reactive alkoxysilane groups with tetraethyl orthosilicate, and the fluoroceramer comprises a fluorinated polyurethane silicate hybrid organic-inorganic network formed as a reaction product of a fluorinated polyurethane having terminal reactive alkoxysilane groups with tetraethyl orthosilicate.

9. The cleaning blade member of any of embodiments 1 to 8 wherein the outermost layer has a thickness of at least 1 μm and up to and including 20 μm.

10. The cleaning blade member of any of embodiments 1 to 9 wherein the outermost layer has a thickness of at least 3 μm and up to and including 12 μm.

11. The cleaning blade member of any of embodiments 1 to 10 wherein the outermost layer comprises a silicon oxide network comprising at least 10 weight % and up to and including 80 weight % of the non-particulate ceramer or fluoroceramer.

12. The cleaning blade member of any of embodiments 1 to 11 wherein the outermost layer has a static or dynamic (kinetic) coefficient of friction less than 0.5.

13. The cleaning blade member of any of embodiments 1 to 12 wherein the outermost layer is transparent.

14. The cleaning blade member of any of embodiments 1 to 13 wherein the polymer substrate comprises a polyurethane.

15. The cleaning blade member of any of embodiments 1 to 14 wherein the outermost layer has a storage modulus of at least 0.1 GPa and up to and including 2 GPa.

16. An electrostatic apparatus comprising:

a toner-carrying member, and the cleaning blade member of any of embodiments 1 to 15 that is capable of cleaning the toner-carrying member.

17. The apparatus of embodiment 16 wherein the toner-carrying member is a photoconductor or an intermediate transfer member.

18. The apparatus of embodiment 16 or 17 further comprising a charging device that produces electric charge on a toner image carrier, an exposure device that forms an electrostatic latent image on the toner image carrier, and a developing device that develops the electrostatic latent image with a developer containing the toner to form a toner image.

19. The apparatus of embodiment 18 that further comprises a receiver element device that can hold toner receiver elements to which a toner image can be transferred from an intermediate transfer member.

20. The apparatus of embodiment 18 or 19 further comprising a fixing unit for fixing the toner image on one or more toner receiver elements.

The following Examples are provided to illustrate the practice of this invention and are not meant to be limiting in any manner.

Preparation of Ceramer and Fluoroceramer Solutions:

10 Weight % Fluoroceramer Masterbatch:

To a 500 ml, three-neck round bottom flask containing dry tetrahydrofuran (THF) (150 ml) under nitrogen were added Terathane™ 650 polytetramethylene glycol (19.45 g, 0.030 mol), 1,4-butanediol (4.25 g, 0.047 mol), Polyfox® PF-6320 surfactant (5.36 g, 0.0014 mol), and trimethylolpropane (1.30 g, 0.010 mol). The resulting mixture was stirred under nitrogen until a solution was obtained and then isophorone diisocyanate (19.64 g, 0.088 mol) was added, and the mixture was degassed under reduced pressure (0.1 mm Hg). Dibutyltin dilaurate (0.10 g, 0.0002 mol) was added, and the resulting mixture was heated at 60° C. under nitrogen for 5 hours. To this solution, were added 3-isocyanatopropyltriethoxysilane (4.04 g, 0.0081 mol) and additional THF (35 ml). The mixture was heated at 60° C. for 15 hours, yielding a solution containing 24 weight % dissolved solids.

Invention Example 1

10 Weight % Fluorinated Ceramer with 1.47 TEOS/Polymer and 0.67 MEK-ST Silica/TEOS In a glass jar, to a stirred solution of ORGANOSILICASOL™ MEK-ST (19.86 g), isopropyl alcohol (19 ml), and 0.15 N triflic acid (3.42 ml) was added the 10 weight % Fluoroceramer Masterbatch (25.0 g) that had been previously diluted with isopropanol (IPA) (20 ml). Additional IPA (60 ml) was added slowly to achieve a clear solution of the fluoroceramer containing the silica particles, followed by dropwise addition of tetraethoxyorthosilicate (TEOS, 8.83 g, 0.039 mol). The solution was then stirred at room temperature for 48 hours, after which Silwet® L-7001 (0.88 g of a 10 weight % solution in IPA) was added. The solution was stirred overnight and diluted with 62 g of addition IPA to 8 weight % solids before coating onto polyurethane blades.

The polyurethane cleaning blade substrates were spray coated with this solution using a Preval™ lab sprayer or coated with a brush. The coatings were cured by placing the cleaning blade members in an oven and increasing the temperature to 80° C. over 1 hour and maintaining the temperature for 24 hours. Alternatively, a ring-coater was used to pull a polyurethane slab (for example, 380 mm×25 mm×1.9 mm) through a gasket that had the fluoroceramer coating solution sitting on top of it. The coating was cured as described above and attached to a metal housing to form a fluoroceramer coated polyurethane cleaning blade.

These fluoroceramer coated cleaning blade members were analyzed for coefficient of friction. A 6.5 cm in length strip of coated elastomer was attached to the bottom of a 200 g weighted sled using double sided plastic adhesive tape. The sled was pulled over a sheet of photoconductor that had been placed on a vacuum platen. A load cell was used to measure the force needed to move the fluoroceramer coating against the photoconductor, the results were recorded using a computer, and the static and dynamic coefficients of friction were calculated. A graph was generated during these experiments to eliminate samples where the sled 200 g weight would leap or jump because of a stick-slip type of friction. The fluoroceramer coated wiper blade of this invention was found to have a static coefficient of friction of 0.5 and a kinetic coefficient of friction of 0.4. In contrast, the uncoated polyurethane elastomer stuck to the photoconductor and the coefficient of friction could not be measured.

Invention Example 2 and Comparative Example 1

Cleaning Blade Members with and without Fluoroceramer Coating and with Toner on the Blade Versus Dry No Toner Wiper blades are defined as cleaning blade members in which the elastomer coating of the cleaning blade member bends in the same direction that the web moves. Wiper blades are described for example in U.S. Pat. No. 6,453,154 (noted above). Wiper blades were prepared by coating a polyurethane substrate fluoroceramer-nanoparticle composition according to this invention using a brush for comparison with non-coated wiper blades. All of the wiper blades were then coated with toner particles to act as lubricants and were compared at starting angles of 80° and 85°. The starting angle was the angle that the wiper blade made with the surface to be cleaned under no load or no deformation.

PU: Polyester Polyurethane, 75 Shore A thickness: 0.050 inch (1.27 mm)

free extension: 0.250 inch (6.35 mm)

blade starting angle: 80° or 85°

NexPress Image Cylinder diameter of 181.9 mm

Conditions: FLC: fluoroceramer (dry or toner coated edge), no

Fluoroceramer coated (dry or toner coated)

Figure 4:
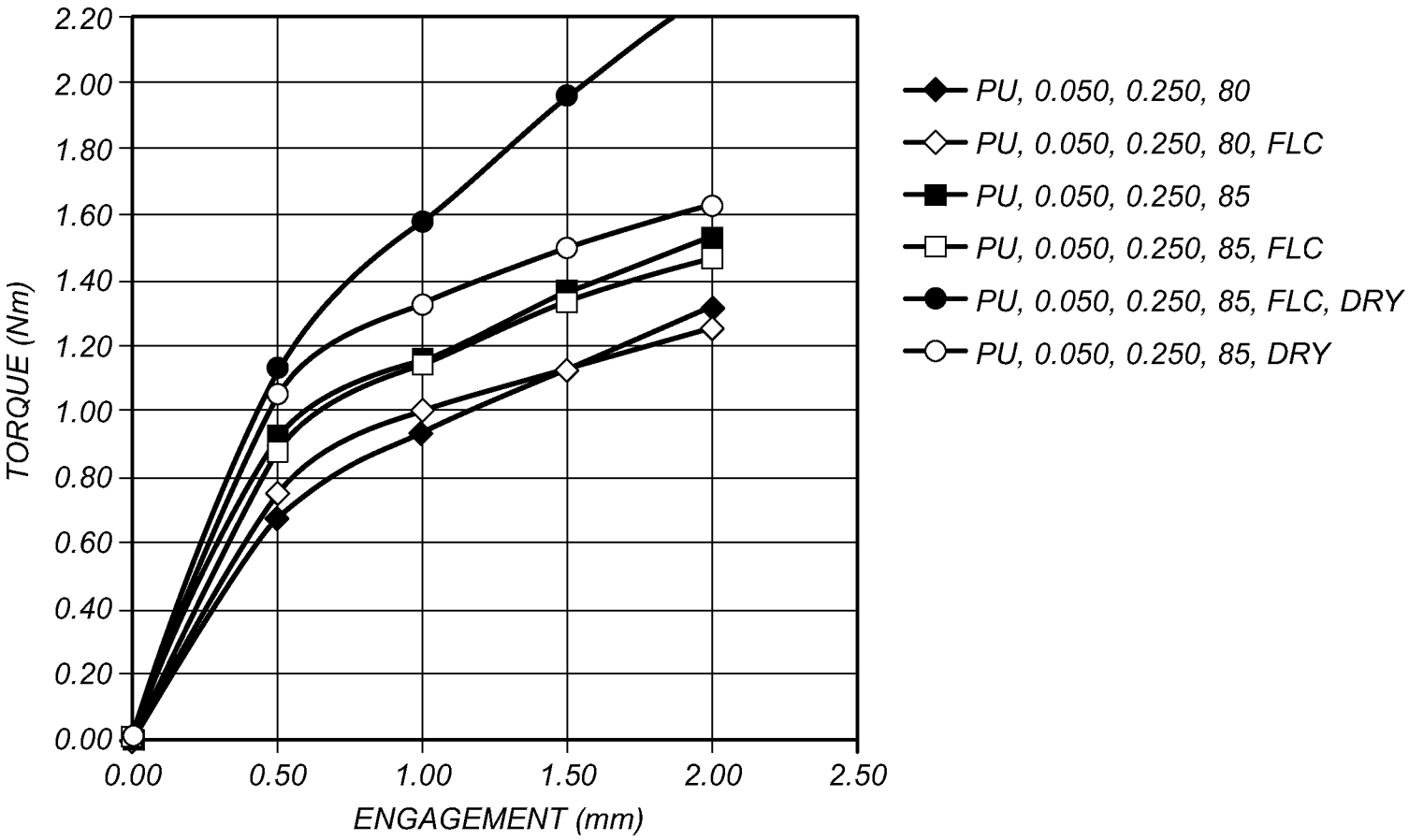
FIG. 4 is a graphical representation of data obtained in Invention Example 2 and Comparative Example 1 described below.

As shown in FIG. 4, there was little difference in the torque measured with either wiper blade coated with toner particles. At an angle of 80° the two wiper blades with toner particles show an increase in torque from about 0.75 Nm to about 1.28 Nm as the engagement of the wiper blade against the NexPress Imaging Cylinder was increased from 0.5 mm to 2.0 mm (two lower curves). An increase of the angle to 85° also yielded similar results for the two wiper blades coated with toner particles with the torque increasing from 0.9 Nm to 1.5 Nm as the engagement was increased from 0.5 to 2.0 mm (middle two curves). However, a substantial difference in performance was observed for the "dry" (DRY) blades that were not treated with toner particles or were wiped clean to remove toner particles from its surface (two top curves). Under these conditions, the wiper blades (cleaning blade members) of the present invention provided much lower torque than the clean, uncoated polyurethane cleaning blade. The wiper blade that was mounted at 85° showed only a modest increase in torque over the wiper blades that were also coated with toner particles, going from 1.0 Nm to 1.6 Nm as the engagement was increased from 0.5 to 2.0 mm. Under the same conditions, the polyurethane wiper blade produced torque readings of 1.15 Nm to 2.0 Nm. The lower coefficient of friction of the wiper blades of this invention can provide improved cleaning performance, more wear resistance, and reduced sensitivity of the cleaning blade member torque load due to toner lubrication.

Invention Example 3

Cleaning Blade Members-Scraper Blades

An evaluation of scraper blades of this invention was carried out by coating a polyurethane slab from ZATEC (75 Shore A) with a composition used in the present invention (ring coated) to provide a scraper blade of this invention versus an uncoated scraper blade outside of this invention. Each scraper blade thickness was 0.050 inch (1.27 mm) and the free extension was 12 mm. Each scraper blade was mounted to a NexPress Image Cylinder cleaner to make a starting angle with the Image Cylinder surface of 154° (or 26° when measured with a tangent through the cleaned surface) as illustrated below, and each scraper blade was coated with 6 μm toner particles. The uncoated scraper blade flipped or was inverted during the evaluation (even with the toner particle coating) and no torque measurement could be taken. The scraper blade of this invention was stable and the torque measurement was about 382 mm at an engagement of 1 mm when it was coated with the toner particles. The coating composition described for use in the practice of this invention allowed the scraper blades to be mounted at a lower ratio of dry thickness to free extension than is normally used in commercial applications and provides less sensitivity to toner lubrication. Other techniques for coating cleaning blade members with powders such as Kynar 301F, Teflon, and others can provide some of the benefits but those powders do not provide durable coatings on cleaning blade members and such cleaning blade members would "flip" in the scraper blade mode of operation.

The scraper blade of this invention was used in an electrostatographic apparatus and appeared to clean most of the toner particles left from transfer to an intermediate transfer member of a "blanket" cylinder.

The invention has been described in detail with particular reference to certain preferred embodiments thereof, but it will be understood that variations and modifications can be effected within the spirit and scope of the invention.

PARTS LIST

| | |
|---|---|
| 12, 14 | Cleaning blade members |
| 12B, 14B | Cleaning blade member elements |
| 13 | Cleaning blade member element |
| 15 | Rigid stiffening plate |
| 15B | Bend |
| 16 | Sump housing |
| 17 | Fastener |
| 18 | Lid member |
| 18C | Flange |
| 18D | Second flange |
| 19 | Cavity |
| 22A, 22B | Notches |
| 25 | Flexible seal blade |
| 29 | Seal |
| 100 | Electrophotographic Document Printer |
| 103 | Primary image-forming member (or Image Cylinder) |
| 104 | Cleaning brush (or image cylinder cleaner) |
| 105 | Corona charger |
| 106 | Laser scanner (LS) |

-continued

PARTS LIST

| | |
|---|---|
| 107 | Magnetic brush applicator |
| 108 | Intermediate transfer member (or "blanket" cylinder) |
| 109 | Transfer nip |
| 110 | Second image-transfer nip |
| 111 | Cleaning brush (or intermediate transfer cleaner or "blanket" cylinder cleaner) |
| 112 | Sheet-feed station |
| 113, 114 | Pair of drive rollers |
| 116 | Sheet-transport web |
| 121 | Transfer roller |
| 124 | Corona charging station |
| 126 | Corona charger |
| 129 | Transport web conditioning charger |
| 130 | Web-cleaning apparatus |
| 141 | Electrically-conductive drum |
| 142 | Overcoat |
| 143 | Compliant blanket |
| 150 | Power supply |
| 152 | Power supply |
| D | Densitometer |
| M | Motor |
| PS | Planar surface of the lid for the web cleaner |
| S | Image-receiver sheet |
| SP | Splice |
| T | Opposing extension tabs |
| t | Cleaning blade member thickness |
| TP | Toned patches |
| w | Cleaning blade member total width |
| w' | Cleaning blade member free extension |
| X | Wiper blade angle |
| Y | Angle of sealing blade |
| Z | Cleaning blade member engagement |

The invention claimed is:

1. A cleaning blade member comprising:

a polymer substrate, and disposed upon the polymer substrate, an outermost layer consisting essentially of a non-particulate, non-elastomeric ceramer or fluoroceramer and nanosized inorganic particles that are distributed within the non-particulate ceramer or fluoroceramer in an amount of at least 5 weight % and up to and including 50 weight % of the outermost layer.

2. The cleaning blade member of claim 1 wherein the inorganic particles have an average largest dimension of at least 1 nm and up to 500 nm.

3. The cleaning blade member of claim 1 wherein the inorganic particles have an average largest dimension of at least 10 nm and up to and including 100 nm.

4. The cleaning blade member of claim 1 wherein the inorganic particles are silica or alumina particles.

5. The cleaning blade member of claim 1 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound.

6. The cleaning blade member of claim 5 wherein the ceramer polyurethane having terminal alkoxysilane groups comprises the reaction product of one or more aliphatic non-fluorinated polyols having terminal hydroxyl groups and an alkoxysilane alkyl-substituted isocyanate compound, and the fluoroceramer polyurethane having terminal alkoxysilane groups comprises the reaction product of one or more fluorinated aliphatic polyols having terminal hydroxyl groups, one or more non-fluorinated aliphatic polyols having terminal hydroxyl groups, and an alkoxysilane alkyl-substituted isocyanate compound.

7. The cleaning blade member of claim 1 wherein the ceramer comprises a polyurethane silicate hybrid organic-inorganic network formed as a reaction product of a non-fluorinated polyurethane having terminal reactive alkoxysilane groups with a tetraalkoxysilane compound, and the fluoroceramer comprises a fluorinated polyurethane silicate hybrid organic-inorganic network formed as a reaction product of a fluorinated polyurethane having terminal reactive alkoxysilane groups with a tetraalkoxysilane compound, wherein the tetraalkoxysilane compound is tetramethyl orthosilicate, tetrabutyl orthosilicate, tetrapropyl orthosilicate, or tetraethyl orthosilicate.

8. The cleaning blade member of claim 1 wherein the ceramer comprises a polyurethane silicate hybrid organic-inorganic network formed as a reaction product of a non-fluorinated polyurethane having terminal reactive alkoxysilane groups with tetraethyl orthosilicate, and the fluoroceramer comprises a fluorinated polyurethane silicate hybrid organic-inorganic network formed as a reaction product of a fluorinated polyurethane having terminal reactive alkoxysilane groups with tetraethyl orthosilicate.

9. The cleaning blade member of claim 1 wherein the outermost layer has a thickness of at least 0.5 μm and up to and including 20 μm.

10. The cleaning blade member of claim 1 wherein the outermost layer has a thickness of at least 3 μm and up to and including 12 μm.

11. The cleaning blade member of claim 1 wherein the outermost layer comprises a silicon oxide network comprising at least 10 weight % and up to and including 80 weight % of the non-particulate ceramer or fluoroceramer.

12. The cleaning blade member of claim 1 wherein the outermost layer has a static or dynamic (kinetic) coefficient of friction less than 0.5.

13. The cleaning blade member of claim 1 wherein the outermost layer is transparent.

14. The cleaning blade member of claim 1 wherein the polymer substrate comprises a polyurethane.

15. The cleaning blade member of claim 1 wherein the outermost layer has a storage modulus of at least 0.1 GPa and up to and including 2 GPa.

16. An electrostatic apparatus comprising:

a toner-carrying member, and the cleaning blade member of claim 1 that is capable of cleaning the toner-carrying member.

17. The apparatus of claim 16 wherein the toner-carrying member is a photoconductor or an intermediate transfer member.

18. The apparatus of claim 16 further comprising a charging device that produces electric charge on a toner image carrier, an exposure device that forms an electrostatic latent image on the toner image carrier, and a developing device that develops the electrostatic latent image with a developer containing the toner to form a toner image.

19. The apparatus of claim 18 that further comprises a receiver element device that can hold toner receiver elements to which a toner image can be transferred from an intermediate transfer member.

20. The apparatus of claim 18 further comprising a fixing unit for fixing the toner image on one or more toner receiver elements.

* * * * *